US009263826B2

(12) United States Patent
Wu et al.

(10) Patent No.: US 9,263,826 B2
(45) Date of Patent: Feb. 16, 2016

(54) CONNECTOR ASSEMBLY WITH CABLE TIE

(71) Applicant: ShenZhen Goldsun Network Intelligence Technology Co., Ltd., ShenZhen (CN)

(72) Inventors: Yi-Fang Wu, New Taipei (TW); Foo See Woei, Shenzhen (CN)

(73) Assignee: ShenZhen Goldsun Network Intelligence Technology Co., Ltd., ShenZhen (CN)

( * ) Notice: Subject to any disclaimer, the term of this patent is extended or adjusted under 35 U.S.C. 154(b) by 0 days.

(21) Appl. No.: 14/475,478

(22) Filed: Sep. 2, 2014

(65) Prior Publication Data

US 2015/0064961 A1 Mar. 5, 2015

(30) Foreign Application Priority Data

Sep. 2, 2013 (CN) ..... 2013 1 03915188

(51) Int. Cl.
*H01R 13/58* (2006.01)
*H01R 13/56* (2006.01)

(52) U.S. Cl.
CPC ..... *H01R 13/5841* (2013.01); *H01R 13/567* (2013.01)

(58) Field of Classification Search
CPC ... H01R 13/5841; H01R 13/562; H01R 13/53
See application file for complete search history.

(56) References Cited

U.S. PATENT DOCUMENTS 4,959,021 A * 9/1990 Byrne ..... H01R 35/02 439/1
8,070,507 B1 * 12/2011 Liang ..... H01R 13/562 439/446
8,523,600 B2 * 9/2013 Hosokawa ..... H01R 43/26 439/445
2010/0124837 A1 * 5/2010 Gimenes ..... H01R 13/5812 439/446
2013/0005176 A1 * 1/2013 Zhou ..... H01R 35/02 439/446

* cited by examiner

*Primary Examiner* — Gary Paumen
(74) *Attorney, Agent, or Firm* — Novak Druce Connolly Bove + Quigg LLP

(57) ABSTRACT

A connector assembly in a vending machine is disclosed. The connector assembly includes a connector body and a cable tie. The connector body includes a mounting case and a pivoting part. The mounting case defines a plurality of inserting holes configured for receiving a first end of cables. The pivoting part includes a connecting portion and a pivoting portion coupled to the connecting portion. The cable tie includes an installation portion defining a plurality of cable holes configured for receiving a second end of cables and a rotating end coupled to the installation portion and rotatably mounted in the pivoting portion. The cable tie is rotatable relative to the connector body to rotate the second end relative to the first end.

20 Claims, 5 Drawing Sheets

CONNECTOR ASSEMBLY WITH CABLE TIE

CROSS-REFERENCE TO RELATED APPLICATIONS

This application claims priority to Chinese Patent Application No. 201310391518.8 filed on Sep. 2, 2013 in the China Intellectual Property Office, the contents of which are incorporated by reference herein.

FIELD

The subject matter herein generally relates to connector assemblies, and more particularly to a connector assembly with a cable tie.

BACKGROUND

Connectors are used to electronically connect a first object to a second object. The connector includes a contact, a terminal, an interface, and other conductors. For example, a first connector is connected to a second connector via a number of cables, and the second connector is connected to a circuit board to electronically couple the first connector with the circuit board. The cables of the connectors can be cluttered with different rotating angles between the first connector and the second connector.

BRIEF DESCRIPTION OF THE DRAWINGS

Implementations of the present technology will now be described, by way of example only, with reference to the attached figures, wherein.

DETAILED DESCRIPTION

Figure 1:
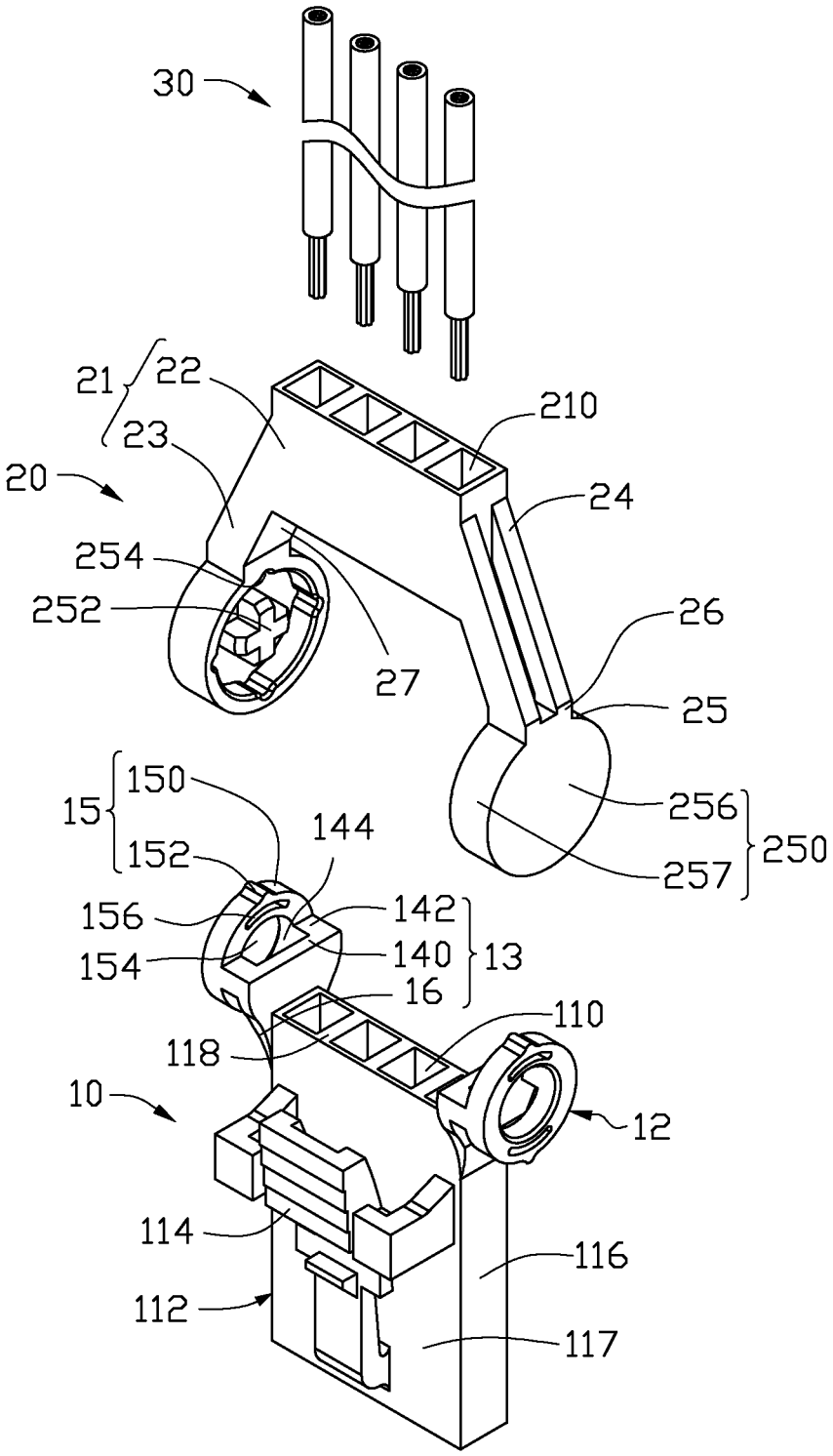
FIG. 1 is an assembled isometric view of one embodiment of a connector assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a connector assembly comprising a connector body and a cable tie. The connector body comprises a mounting case and a pivoting part. The mounting case defines a plurality of inserting holes configured for receiving a first end of cables. The pivoting part comprises a connecting portion coupled to the connector body and a pivoting portion coupled to the connecting portion. The cable tie comprises an installation portion defining a plurality of cable holes configured for receiving a second end of cables and a rotating end coupled to the installation portion and rotatably mounted in the pivoting portion. The cable tie is rotatable relative to the connector body to rotate the second end of the cables relative to the first end.

Figure 2:
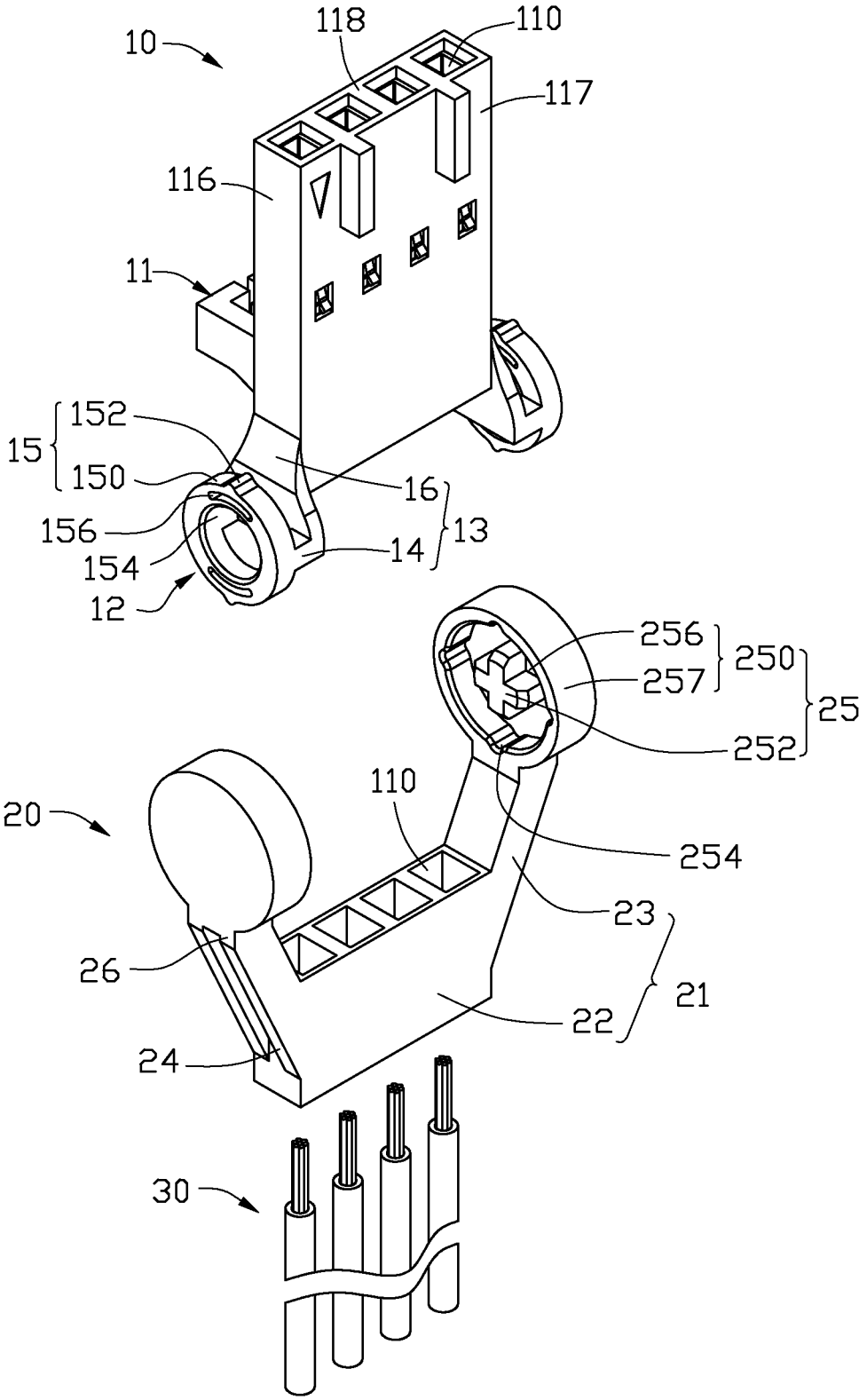
FIG. 2 is similar to FIG. 1, but viewed from a different angle.

FIG. 1 and FIG. 2 illustrate one embodiment of a connector assembly. The connector assembly includes a connector body 10 and a cable tie 20.

The connector body 10 can include a mounting case 112, a latching portion 114, and two pivoting parts 12 extending from the mounting case 112. The mounting case 112 defines a plurality of insertion holes 110 for inserting a plurality of cables 30 and includes two first sidewalls 116, two second sidewalls 117 extending between the two first sidewalls 116, and a top wall 118 coupled with the two first sidewalls 116 and the two second sidewalls 117. The insertion holes 110 extend downwards from the top wall 118. The latching portion 114 extends from one of the second sidewalls 117 and can be configured for latching with another connector (not shown).

Each pivoting part 12 can include a connecting portion 13 and a pivoting portion 15. The connecting portion 13 includes a connecting arm 16 extending from each first sidewall 116, an extension 140 extending from the connecting arm 16, and two connecting tabs 142 extending outwards from an outer surface of the extension 140. A gap 144 is defined between the two connecting tabs 142. A cross section of the extension 140 is semicircular. The pivoting portion 15 defines a pivoting hole 154 and can include an installation ring 150 surrounding the pivoting hole 154 and two protrusions 152 extending outwards from an outer ring surface of the installation ring 150. A cross section of the installation ring 150 is circular. In the illustrated embodiment, the installation ring 150 is substantially parallel to the extension 140, and each protrusion 152 is curved. The installation ring 150 can define two curved slots 156 for being elastically deformed easier.

The cable tie 20 can include an installation portion 21 and two rotating ends 25. The installation portion 21 includes an installation case 22 and two holding arms 23 extending from opposite sides of the installation case 22. The installation case 22 defines a plurality of cable holes 210 corresponding to the inserting holes 110. Each holding arm 23 includes a rear plate 27 extending from the installation case 22, two holding ribs 24 extending from the rear plate 27, and a connecting plate 26 coupled with the two holding ribs 24. The connecting plate 26 is substantially a "U" shaped.

Each rotating end 25 can include a receiving box 250 and a rotating portion 252 located in the receiving box 250. The receiving box 250 includes a mounting plate 257 coupled with the connecting plate 26 and a receiving ring 256 extending from edges of the connecting plate 26. The rotating portion 252 extends from the mounting plate 257 and is located in the receiving ring 256. An inner ring surface of the receiving ring 256 defines a plurality of limiting slots 254. In the illustrated embodiment, the mounting plate 257 is circular, and the rotating portion 252 is cruciform.

Figure 3:
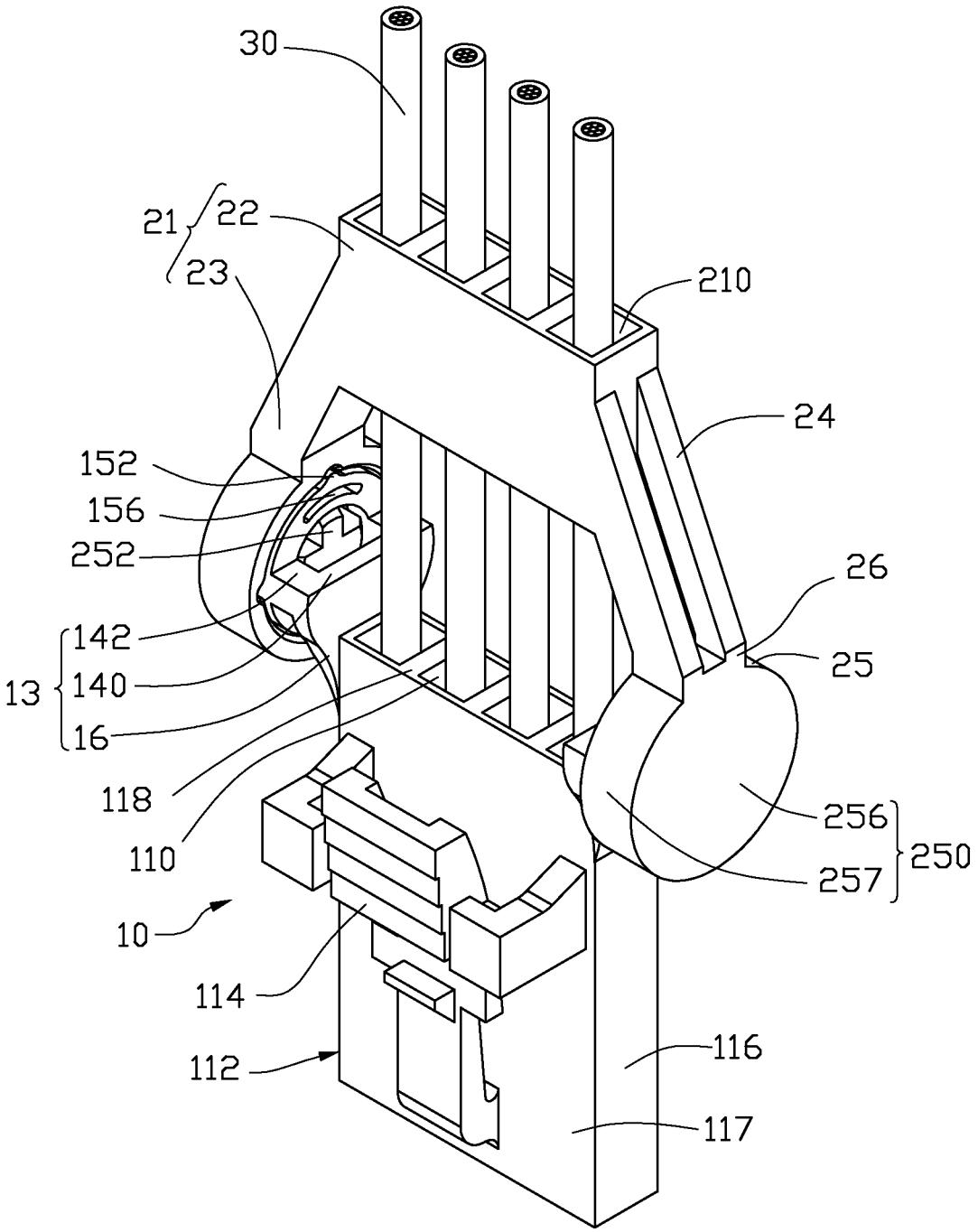
FIG. 3 is an assembled isometric view of the connector assembly of FIG. 1, showing a cable tie in a first position.

FIG. 3 illustrates that when the connector assembly is in an assembled configuration, the connecting arms 16 are elastically deformed to position the two pivoting parts 12 between the two rotating ends 25 with the rotating portions 252 aligned to the pivoting holes 154, and two of the limiting slots 254 are aligned with the protrusions 152. The connecting arms 16 rebound to receive the rotating portions 252 in the gap 144 via the pivoting holes 154, the rotating portion 252 abuts the extension 140, and the protrusions 152 are received in the two limiting slots 254. In this position, the cable tie 20 is located in a first position relative to the connector body 10, the cable holes 210 are aligned with the inserting holes 110, a first end of each cable 30 is inserted in the inserting hole 110, and a second end of each cable 30 is inserted through the cable hole 210. The second end of each cable 30 extends in a first angle relative to the first end. In the illustrated embodiment, the cable 30 is straight.

Figure 4:
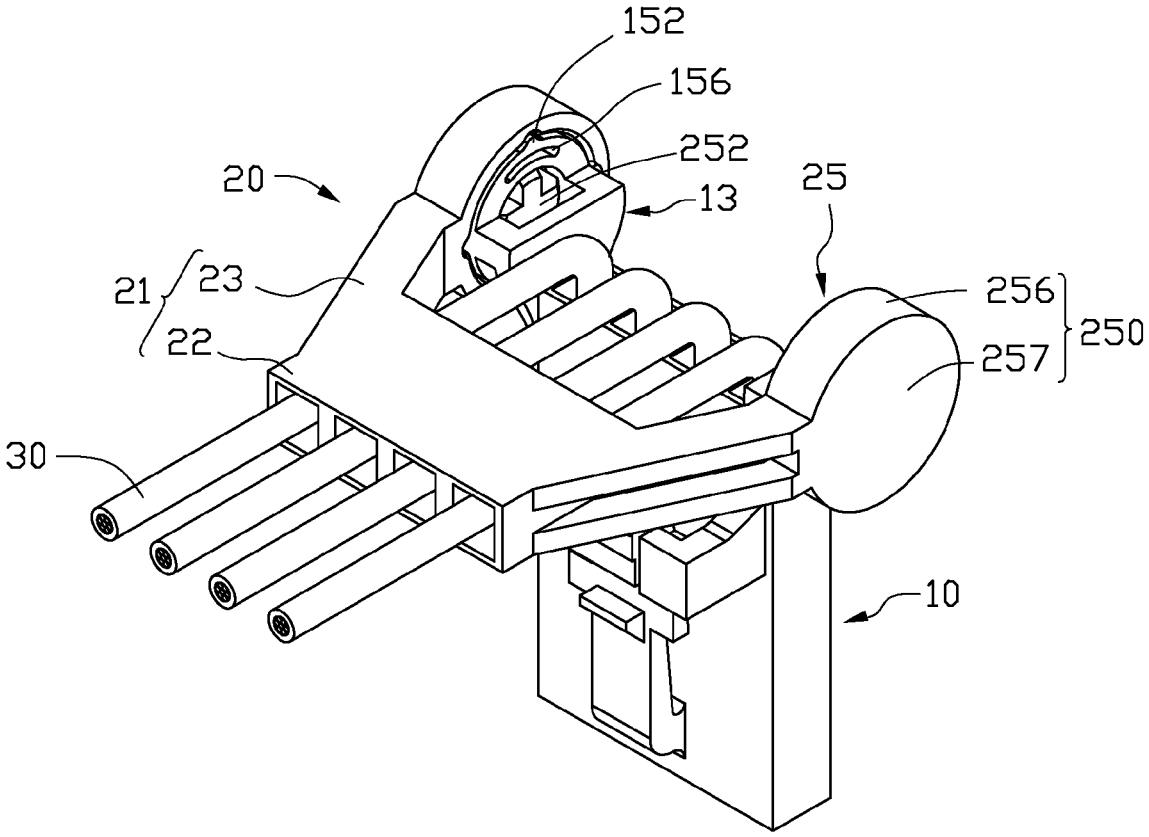
FIG. 4 is similar to FIG. 3, but showing the cable tie in a second position.

FIG. 4 illustrates that the cable tie 20 can be rotated to a second position relative to the connector body 10 in a first direction. When the cable tie 20 is rotated from the first position to the second position, the rotating portions 252 are rotated in the pivoting holes 154, the protrusions 152 disengage from the two limiting slots 254 and rotate along the inner ring surface of the receiving ring 256 by elastically deforming the installation ring 150, until aligning with another two limiting slots 252. The installation ring 150 rebounds to engage the protrusions 152 in another two limiting slots 252. The cable tie 20 rotates the second end of each cable 30 in the first direction, and extends the second end of each cable 30 to a second angle relative to the first end of the cable 30 along the first direction. In the illustrated embodiment, the second angle is 90 degrees.

Figure 5:
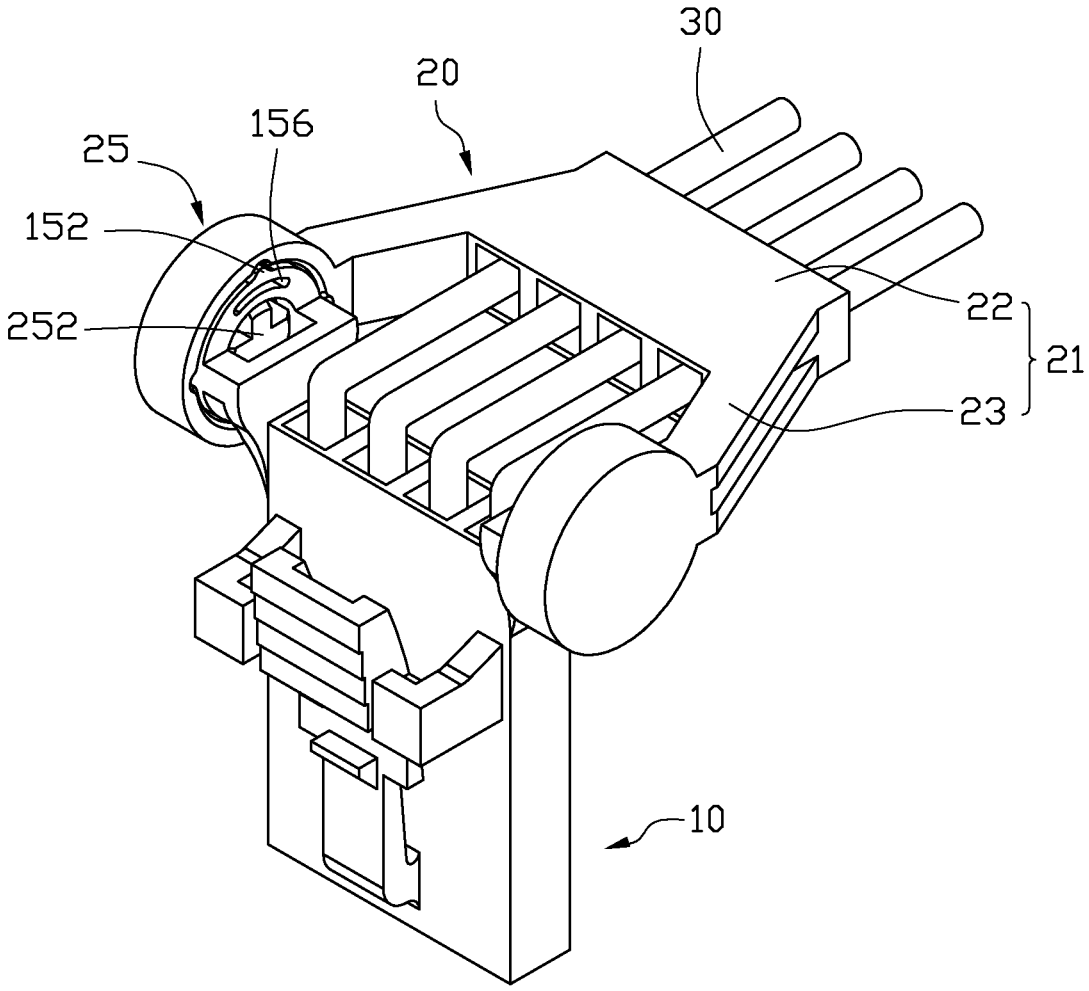
FIG. 5 is similar to FIG. 4, but showing the cable tie in a third position.

FIG. 5 illustrates that the cable tie 20 can be rotated to a third position relative to the connector body 10 in a second direction, opposite to the first direction. When the cable tie 20 is rotated from the first position to the third position, the rotating portions 252 are rotated in the pivoting holes 154. The protrusions 152 disengage from the two limiting slots 254 and rotate along the inner ring surface of the receiving ring 256 by elastically deforming the installation ring 150, until aligning with another two limiting slots 254. The installation ring 150 rebounds to engage the protrusions 152 in another two limiting slots 254. The cable tie 20 rotates the second end of each cable 30 in the second direction, and extends the second end of each cable 30 in a third angle relative to the first end of the cable 30 along the second direction. In the illustrated embodiment, the third angle is 90 degrees.

The embodiments shown and described above are only examples. Many details are often found in the art such as the other features of a connector assembly. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A connector assembly comprising:

a connector body including a mounting case defining a plurality of inserting holes configured for receiving a first end of cables, and a pivoting part comprising a connecting portion coupled to the connector body and a pivoting portion coupled to the connecting portion; and a cable tie having an installation portion defining a plurality of cable holes configured for receiving a second end of cables, and having a rotating end coupled to the installation portion, rotatably mounted in the pivoting portion;

wherein the cable tie is rotatable relative to the connector body to rotate the second end of the cables relative to the first end.

2. The connector assembly of claim 1, wherein the pivoting portion comprises an installation ring coupled to the connecting portion and a protrusion extending from an outer ring surface of the installation ring, the rotating end comprises a receiving box and a rotating portion located in the receiving box; an inner surface of the receiving box defines a plurality of limiting slots; the protrusion is engaged in one of the limiting slots; and when the cable tie is rotated relative to the connector body, the protrusion is disengaged from the one of the limiting slots and engaged in another limiting slot.

3. The connector assembly of claim 2, wherein the rotating end defines a pivoting hole, and the installation ring surrounds the pivoting hole; the rotating portion is received in the pivoting hole; and the installation ring is received in the receiving box.

4. The connector assembly of claim 2, wherein the installation ring defines a curved slot.

5. The connector assembly of claim 2, wherein each of the limiting slots and the protrusion is curved.

6. The connector assembly of claim 2, wherein the receiving box comprises a receiving ring and a mounting plate covering a side of the receiving ring, the limiting slots are defined in an inner ring surface of the receiving ring.

7. The connector assembly of claim 1, wherein the installation portion comprises an installation case and a holding arm connecting the installation case to the rotating end, and the cable holes are defined in the installation case.

8. The connector assembly of claim 7, wherein the holding arm comprises two holding ribs secured to each side of the installation case and a connecting plate connecting the two holding ribs to the rotating end.

9. The connector assembly of claim 3, wherein the connecting portion comprises a connecting arm extending from the mounting case, an extension extending from the connecting arm, and two connecting tabs extending from the extension, and the pivoting portion extends from the two connecting tabs.

10. The connector assembly of claim 9, wherein the extension is semicircular, a gap is defined between the two connecting tabs, and the gap communicates with the pivoting hole.

11. A connector assembly comprising:

a connector body including a mounting case defining a plurality of inserting holes configured for receiving a first end of cables, and a pivoting part comprising a connecting portion coupled to the connector body and a pivoting portion coupled to the connecting portion; and a cable tie having an installation portion defining a plurality of cable holes configured for receiving a second end of cables, and having an end coupled to the installation portion, rotatably mounted in the pivoting portion;

wherein the pivoting portion comprises a protrusion, the rotating end defines a plurality of limiting slots, and the protrusion is engaged in one of the limiting slots; and the cable tie is rotatable relative to the connector body in opposite directions to engage the protrusion in another limiting slot from the one of the limiting slots, causing the second end of the cables to extend in different directions relative to the first end of the cables.

12. The connector assembly of claim 11, wherein the pivoting portion comprises an installation ring coupled to the connecting portion and a protrusion extending from an outer ring surface of the installation ring, the rotating end comprises a receiving box and a rotating portion located in the receiving box; and an inner surface of the receiving box defines the plurality of limiting slots.

13. The connector assembly of claim 12, wherein the rotating end defines a pivoting hole, and the installation ring surrounds the pivoting hole; the rotating portion is received in the pivoting hole; and the installation ring is received in the receiving box.

14. The connector assembly of claim 12, wherein the installation ring defines a curved slot.

15. The connector assembly of claim 12, wherein each of the limiting slots and the protrusion is curved.

16. The connector assembly of claim 12, wherein the receiving box comprises a receiving ring and a mounting plate covering a side of the receiving ring, the limiting slots are defined in an inner ring surface of the receiving ring.

17. The connector assembly of claim 11, wherein the installation portion comprises an installation case and a holding arm connecting the installation case to the rotating end, and the cable holes are defined in the installation case.

18. The connector assembly of claim 17, wherein the holding arm comprises two holding ribs secured to each side of the installation case and a connecting plate connecting the two holding ribs to the rotating end.

19. The connector assembly of claim 13, wherein the connecting portion comprises a connecting arm extending from the mounting case, an extension extending from the connecting arm, and two connecting tabs extending from the extension, and the pivoting portion extends from the two connecting tabs.

20. The connector assembly of claim 19, wherein the extension is semicircular, a gap is defined between the two connecting tabs, and the gap communicates with the pivoting hole.

* * * * *